US011425990B2

(12) United States Patent
Metzel et al.

(10) Patent No.: US 11,425,990 B2
(45) Date of Patent: Aug. 30, 2022

(54) BEVELED BROOM AND STEP-ON DUSTPAN CLEANING SYSTEM

(71) Applicant: Carl Freudenberg KG, Weinheim (DE)

(72) Inventors: Doug Metzel, Lombard, IL (US); Robert Ancheta, Aurora, IL (US)

(73) Assignee: Carl Freudenberg KG, Weinheim (DE)

( * ) Notice: Subject to any disclaimer, the term of this patent is extended or adjusted under 35 U.S.C. 154(b) by 228 days.

(21) Appl. No.: 16/900,415

(22) Filed: Jun. 12, 2020

(65) Prior Publication Data

US 2021/0289933 A1 Sep. 23, 2021

Related U.S. Application Data

(63) Continuation-in-part of application No. 29/728,539, filed on Mar. 19, 2020, now Pat. No. Des. 939,172, and a continuation-in-part of application No. 29/728,541, filed on Mar. 19, 2020.

(51) Int. Cl.
*A47L 13/52* (2006.01)
*A46B 9/02* (2006.01)

(52) U.S. Cl.
CPC ..... *A46B 9/025* (2013.01); *A46B 9/026* (2013.01); *A47L 13/52* (2013.01); *A46B 2200/302* (2013.01)

(58) Field of Classification Search
CPC ..... A47L 13/52
See application file for complete search history.

(56) References Cited

U.S. PATENT DOCUMENTS

| | | | | |
|---|---|---|---|---|
| 1,908,730 | A | 5/1933 | Caldwell et al. | |
| 4,360,940 | A | 11/1982 | Smith | |
| 7,171,719 | B1 * | 2/2007 | Harrelson | A47L 13/52 15/257.3 |
| 7,854,035 | B2 | 1/2010 | Gullicks et al. | |
| 8,402,590 | B1 | 3/2013 | Larson | |

(Continued)

FOREIGN PATENT DOCUMENTS

| | | | |
|---|---|---|---|
| CN | 201537069 | U | 8/2010 |
| CN | 201798709 | U | 4/2011 |

(Continued)

OTHER PUBLICATIONS

European Patent Office, Search Report in European Patent Application No. 21 17 8921.9, 1 pg. dated Feb. 23, 2022.

(Continued)

*Primary Examiner* — Weilun Lo
(74) *Attorney, Agent, or Firm* — Leydig, Voit & Mayer, Ltd.

(57) ABSTRACT

A beveled broom and step-on dustpan cleaning system including a step-on dustpan having a step-on portion configured to allow a user to collect debris in a receptacle of the dustpan when a force is applied on the step-on portion. The dustpan includes a lip portion which is configured to seal against a floor surface upon a user stepping on the step-on portion to collect debris. A beveled broom having a broom head configured with a beveled or chamfered shape at a functional angle to provide an effective and efficient contact surface to a floor surface to collect debris during use.

16 Claims, 14 Drawing Sheets

(56) References Cited

U.S. PATENT DOCUMENTS

| | | | | |
|---|---|---|---|---|
| 8,875,339 | B2 | 11/2014 | Dobson, III | |
| 2007/0089259 | A1* | 4/2007 | Jones | A46B 15/00 15/257.1 |
| 2012/0260453 | A1 | 10/2012 | Ward et al. | |
| 2013/0152331 | A1 | 6/2013 | Ward et al. | |
| 2014/0130288 | A1* | 5/2014 | Dobson, III | A47L 13/52 15/257.1 |
| 2016/0338564 | A1 | 11/2016 | Ward et al. | |
| 2018/0008115 | A1* | 1/2018 | Trevino | A47L 13/52 |
| 2018/0317735 | A1* | 11/2018 | Dobson, III | A46B 15/0055 |
| 2018/0325345 | A1* | 11/2018 | Varner | A47L 13/52 |

FOREIGN PATENT DOCUMENTS

| | | | |
|---|---|---|---|
| CN | 202426460 | U | 9/2012 |
| CN | 102961098 | A | 3/2013 |
| CN | 103494589 | A | 1/2014 |
| CN | 106923763 | A | 7/2017 |
| CN | 108125641 | A | 6/2018 |
| DE | 202008014257 | U1 | 5/2009 |
| DE | 10 2013 000 501 | A1 | 7/2014 |
| EP | 0913118 | A1 | 5/1999 |
| FR | 3 043 317 | | 5/2017 |
| GB | 778432 | | 7/1957 |
| JP | 4391092 | B2 | 12/2009 |
| WO | WO 2007/068026 | A1 | 6/2007 |
| WO | WO 2013/053160 | A1 | 4/2013 |
| WO | WO 2019/089079 | A1 | 5/2019 |

OTHER PUBLICATIONS

European Patent Office, Partial European Search Report in European Patent Application No. 21178921.9, 9 pp. (dated Nov. 4, 2021).

Quirky, "The Broom Groomer Dustpan from Quirky," YouTube video downloaded from the Internet at https://www.youtube.com/watch?v=8ePiNwWs1DA, 1 p. (May 17, 2011).

The Grommet, "A whole new take on the dustpan and broom," YouTube video downloaded from the Internet at https://www.youtube.com/watch?v=jr_I6IZRHJ8, 1 p. (May 19, 2017).

* cited by examiner

BEVELED BROOM AND STEP-ON DUSTPAN CLEANING SYSTEM

CROSS-REFERENCE TO RELATED APPLICATIONS

This patent application is a continuation-in-part of co-pending U.S. Design patent application Ser. Nos. 29/728,539 and 29/728,541, each filed Mar. 19, 2020, which are hereby incorporated herein by reference in their entireties for all purposes.

BACKGROUND OF THE INVENTION

Conventional brooms have uniform length bristles that contact the floor while sweeping. While the bristles can be pressed against the floor, most bristles contact the floor at an angle such that a lateral surface of each bristle, especially those that are bent, rather than and end of the bristle, sweeps against the floor as the broom is moved. Moreover, when sweeping, almost half of the bristles fail to touch or impact the dirt or debris being swept and only touch air while sweeping.

Additionally, conventional dustpans require a user to bend over or kneel to reach the dustpan while collecting swept dirt and debris. Most users also hold the dustpan at an angle that biases the edge of the collection area against the floor to facilitate swiping of dirt and debris into the dustpan. Such use requires the user to bend and stress their body, which may be uncomfortable for some users.

One solution that has been proposed in the past to address potential challenges with using a waste receptacle such as a dustpan can be seen in U.S. Pat. No. 8,875,339 to Dobson. Dobson describes a dustpan that includes a blade (20, FIG. 1) that is pressed against the floor, as shown in FIGS. 6-8, when the user steps and applies a force a foot-pedal (14, FIG. 1) that is integrated with a handle (16) on the rear of a dustbin (26). While Dobson's device provides some improvement over conventional dustpans, the location of the foot-pedal decreases the overall capacity of the dustbin (26), and while the dustpan is pressed against the floor, the dustbin's flat underside (see 30, FIG. 5) may prevent an effective seal to be created under the blade (20) when the dustpan is used on an uneven surface, or if there is debris present in the area of contact between the dustpan and the floor.

BRIEF SUMMARY OF THE INVENTION

The invention provides a system including a step-on dustpan configured to include a step-on portion, a handle, a lip, a handle clip, a pan surface and side panels. The system also includes a broom configured to include a broom handle, a broom block and beveled bristles. The beveled bristles are disposed in the broom block to form a v-shape in a transverse direction with respect to the broom block. When the step-on portion is engaged by a user, the lip is configured to form a seal against a floor surface.

In one aspect, the present disclosure describes a dustpan that includes a receptacle, which is enclosed on four sides by a bottom pan, two sidewalls and a back panel, and includes a lip at a free end of the bottom pan opposite the back panel. The dustpan further includes a handle connected to the back panel and extending opposite the receptacle. The handle has a curved shape that terminates at a floor pad. The dustpan is configured to only contact a flat floor surface along the floor pad and the lip when in an at-rest position. The dustpan further includes at least one foot disposed on an exterior surface of the receptacle. A step-on portion is defined on the handle and is angled with respect to the flat floor surface and configured to provide a pedal for a user to apply a force. When the force is applied to the pedal, the dust pan transitions from the at-rest position to an operating position in which the handle deforms to permit the at least one foot to further contact the flat floor surface and to decrease an angle between the lip and the flat floor surface.

In another aspect, the disclosure describes a broom having an elongate handle having a first end and a second end. A broom block is connected to the first end of the elongate handle, and a first plurality of bristles is connected to a first section of the broom block. The first plurality of bristles defines a broom head, which has a sweeping end. The sweeping end includes two planar sections, each having an elongate shape, wherein the two planar sections are disposed at an angle relative to one another and intersect a bottom edge to define a bevel along the sweeping end of the broom head.

In yet another aspect, the disclosure describes a cleaning system that includes a broom and a dustpan. The broom has an elongate handle and a broom block connected at one end of the elongate handle. The broom head comprises a first plurality of bristles connected to the broom block, which define a broom head having a sweeping end opposite the broom block. The sweeping end includes two planar sections disposed at an angle relative to one another to define a bevel. The dustpan has a receptacle connected to a handle, which includes a cylindrical channel with locking nubs that is releasably attachable to the elongate handle of the broom. The handle further includes a floor pad opposite its connection to the receptacle, and a lip disposed opposite its connection to the handle such that, when the dustpan is detached from the broom and sits on a flat floor surface in an at-rest position, the dustpan contacts the flat floor surface only along the floor pad and the lip, and remaining portions of the handle and receptacle are suspended above the flat floor surface.

BRIEF DESCRIPTION OF THE SEVERAL VIEWS OF THE DRAWING(S)

DETAILED DESCRIPTION OF THE INVENTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice versa without limiting the scope of the disclosure to the exact number or type of such elements unless set forth explicitly in the appended claims.

The present disclosure is directed to a floor cleaning system that includes a step-on dustpan 100 and beveled broom 300 combination. The combination of the step-on dustpan 100 and the beveled broom 300 provides an effective and more efficient system to collect floor debris than traditional broom and dustpan combinations in that the dustpan can be used on uneven or unclean surfaces while still maintaining ease of use and a good seal at the blade of the dustbin. Further, cleaning effectiveness of the floor cleaning system is improved by providing beveled bristles on the broom, which increases contact area between the broom and the floor and, also, the ability of the broom to push debris past the blade of the dustbin and into the collection cavity of the dustpan. In certain embodiments, the step-on dustpan 100 includes a hands-free feature to assist a user in debris collection without the user bending or kneeling when in use.

Figure 1:
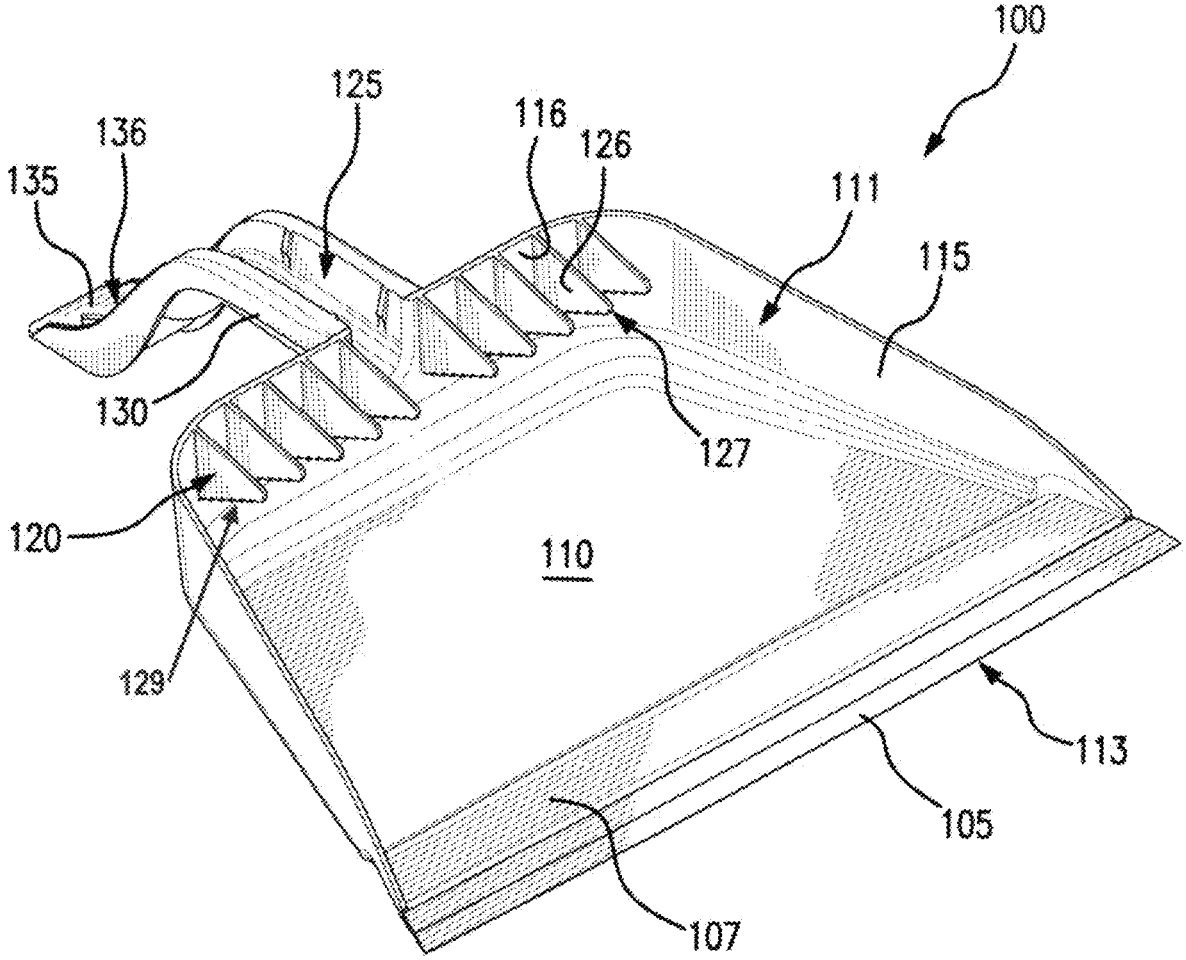
FIG. 1 is a front perspective view of a step-on dustpan according to an embodiment of the disclosure.
Figure 2:
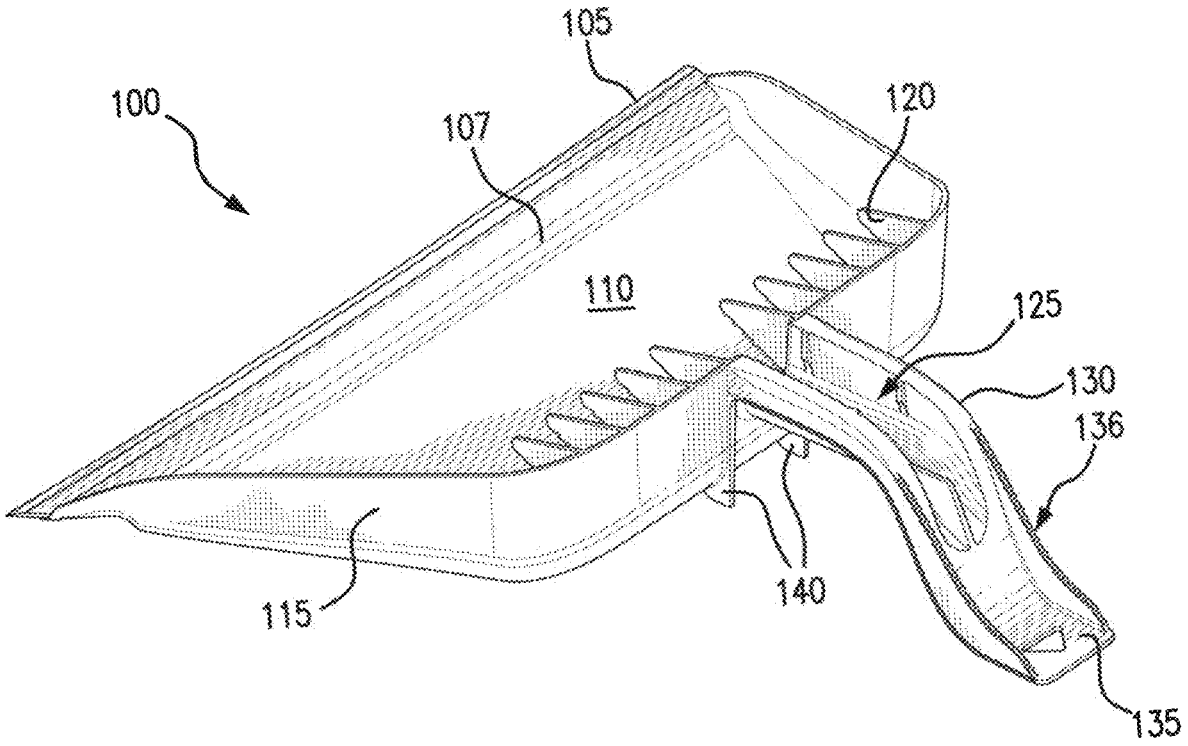
FIG. 2 is a rear perspective view of the step-on dustpan according to an embodiment of the disclosure.

Referring now to FIG. 1, there is a front perspective view of a step-on dustpan 100 according to an embodiment of the disclosure. In certain embodiments, the step-on dustpan 100 comprises a handle 135 that includes an angled step-on portion 136 (shown in FIG. 2). The handle 135 includes a floor pad 137 that contacts the floor 145 (shown in FIG. 5). The floor pad 135 is adjacent the angled step-on portion 136, which also includes ridges 138 that increase contact friction when a user steps on the step-on portion 136. In an alternative embodiment, the ridges 138 may be omitted in favor of a textured surface, for example, a diamond-plate pattern surface, which includes protruding, 3-dimensional features that increase friction between the step-on portion 136 and the bottom of a user's foot. One such pattern may be a molding texture commonly referred to as MT-11620, which includes a staggered arrangement of raised diamond or rhombic features that extend 0.003 in. or 75 μm from the surface. Such embodiment is shown in FIG. 2, where the step-on portion 136 is shown occupying a top or ridge surface of the handle 130.

Figure 6:
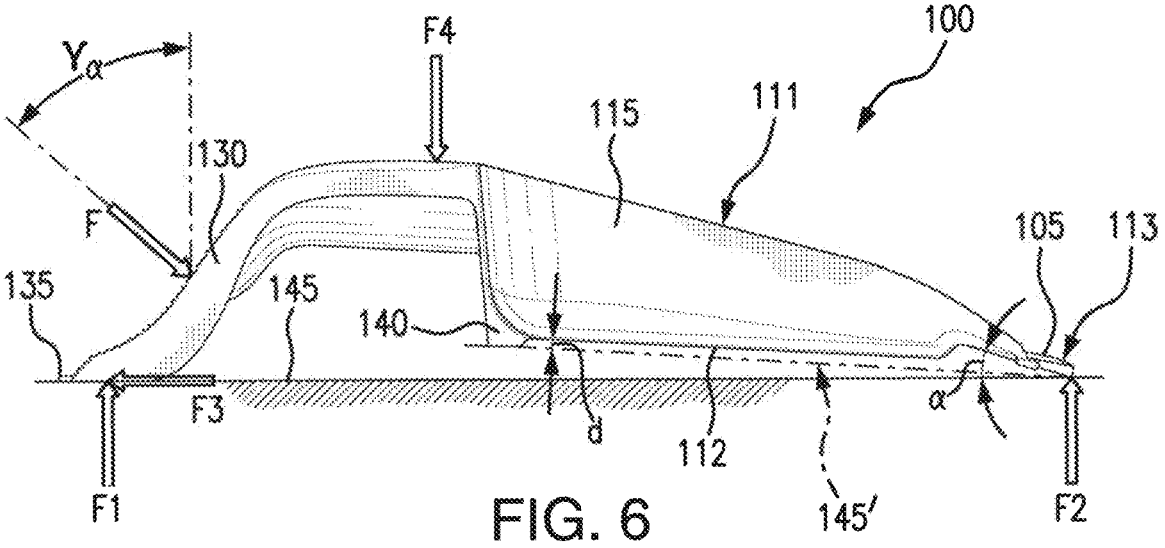
FIG. 6 is a side plan view of another side of the step-on dustpan according to an embodiment of the disclosure.

The floor pad 137 contact with the floor is configured to hold the dustpan 100 in place when a user steps onto the step-on portion 136. A force, F, applied by the user while stepping onto the step-on portion 136 is disposed at an angle, gamma-sub-alpha ($\gamma_\alpha$), as shown in FIG. 6, relative to the floor, which acts as a foot-pedal to both press the floor pad 136 against the floor and also deform a body portion of the handle 130 such that feet 140 (two shown, as can be seen in FIG. 2) also contact the floor while the body portion 130 of the handle is deformed under the force of the user's foot.

The dustpan 100 further includes a pan or debris receptacle 111 that is closed on four sides and open on two sides. The receptacle 111 is defined between a bottom pan surface 110, two side panels 115 and a back panel 116. The bottom pan surface 110 includes a lip or blade 105 along its leading edge opposite the back panel 116 that contacts the floor and has a triangular or beveled edge that terminates in a line edge 113 to facilitate the sweeping of debris into the receptacle 111.

In some embodiments, the action by a user of stepping on the handle step-on portion 136 of the dustpan 100 applies the force F, which causes various other forces to be applied at various locations tending to bias certain portions of the dustpan 100 against the floor and also deform the handle body portion 130 in a direction tending to straighten the handle. More specifically, and as shown in FIG. 6, the user applied force F applied at the angle $\gamma$ causes two vertical reaction forces F1 and F2 applied, respectively, at the floor pad 137 and at the line edge 113. A horizontal reaction force F3, which opposes a horizontal component of the force F, is countered by friction between the floor pad 137 and the floor 145. Due to the relatively small contact area between the line edge 113 and the floor, the friction F3 is larger than any friction between the floor and the line edge 113, which results in a sliding of the line edge 113 against the floor. This sliding, an in addition a vertical component F4 of the force F applied close to a junction between the body 130 of the handle and the receptacle 111 causes the receptacle 111, which is generally rigid compared to the body 130 of the handle, to move as the area between the body of the handle 130 and the receptacle 111 to bend.

Bending of the dustpan 100 in this way augments the biasing force that pushes the lip 105 against a floor 145 and an angle, alpha ($\alpha$) between the lip 105 and the floor 145 to decrease, which facilitates entry of debris into the receptacle 111 and also provides a better seal against dust or debris passing under the lip 105 rather than into the receptacle 111 when swept in past the line edge 113. In this position, the bottom surface of the receptacle may be at an angle of 3 to 5 degrees relative to the floor, which can be reduced to zero when the user steps on the step-on portion 136 and applies a downward force. As can be appreciated, any other angle can also be used. At the lip 105, the angle $\alpha$ will also assume an inclination when the dustpan is at an at-rest condition, and reduce while the user pushes down on the step-on portion 136. In some embodiments, the lip 105 is disposed within or integral to a pan entry lip portion 107 (FIG. 1) where lip portion 107 is angled apart from pan surface 110 to further facilitate entry of debris into the receptacle 111.

As can be seen in FIG. 6, when the dustpan 100 is in the operating position with the force F applied and the body 130 of the handle 135 deflected or disposed into its deformed, biased position, the bottom of the feet 140 contact the floor 145, which is now disposed at dashed line 145'. At this position, the feet 140 maintain a distance, d, between the bottom of the pan surface 110 that permits proper alignment and continuous contact between the line edge 113 and the floor 145 (or 145') on floors that are uneven and/or in instances where debris is trapped or present in an area, A (shown in FIG. 5), between the receptacle 111 and the floor 145 (or 145').

Figure 14:
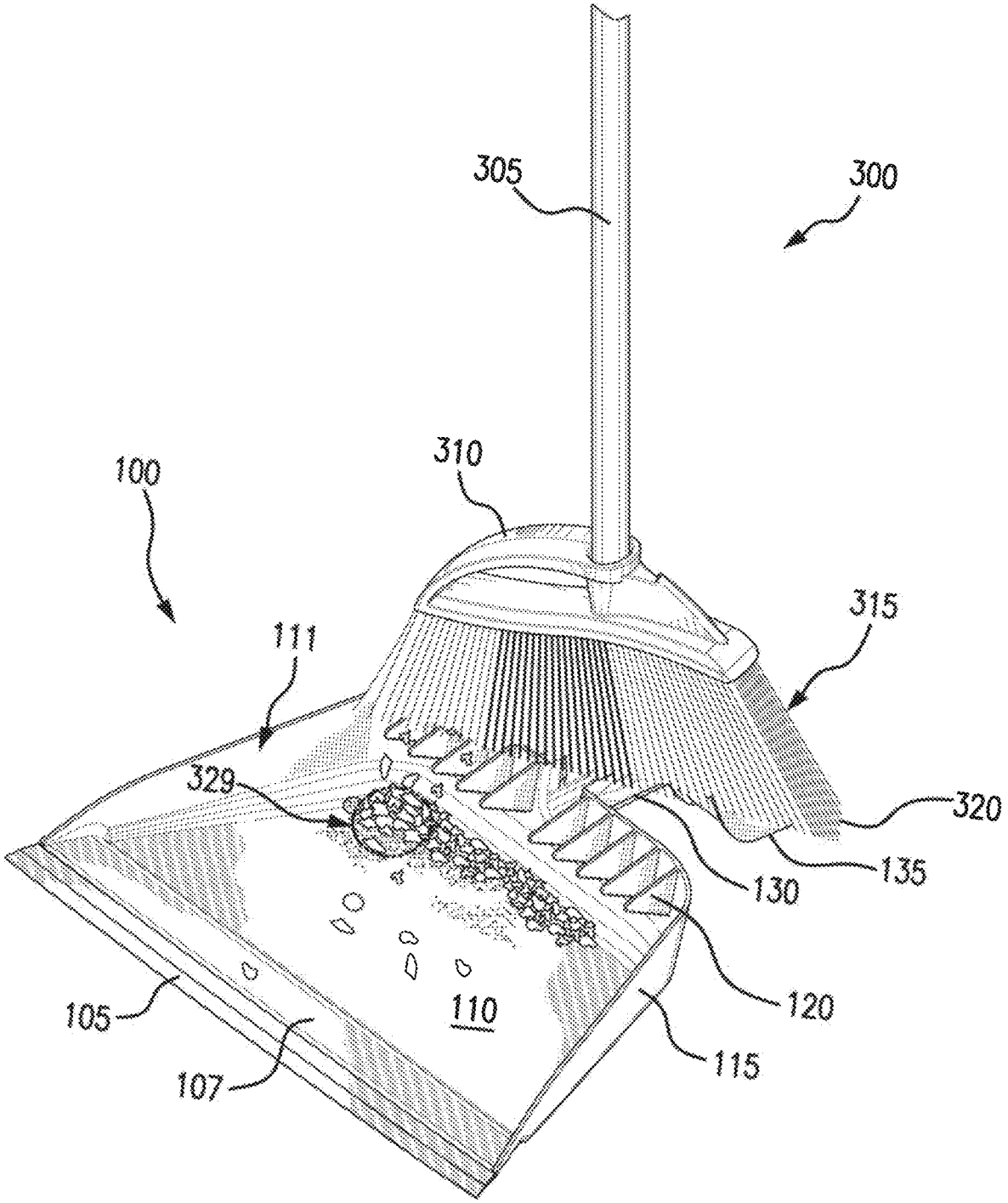
FIG. 14 is a perspective view of the step-on dustpan and the beveled broom according to an embodiment of the disclosure.

In some embodiments, the dustpan 100 comprises a large cleaning comb 120 for removing hair from the broom 300 shown in FIG. 14. In the illustrated embodiment, the comb 120 includes a plurality of triangular fins connected to the back panel 116 and extending, generally perpendicularly relative to the back panel 116, into the area of the receptacle 111. Each fin 126 from the plurality of fins 126 has a generally triangular shape (isosceles, in the embodiment of FIG. 1), having its base connected to the back panel 116 and its sides extending into the receptacle 111 such that the tip 127 is suspended above the bottom pan 110. A lower edge or side of each fin 126 may include serrations 129 to facilitate removal of debris. During use, and as shown in FIG. 14, the tips 127 cut into and separate groups of broom bristles such that hair or other elongate debris that engages more than one group of bristles simultaneously can be engaged by a bottom edge of one or more fins 126 and be retained thereby while the broom passes over the comb 120. Elongate debris thus combed out of the broom then falls into the receptacle 111.

The body 130 of the handle 135 further includes a handle clip 125, which in the illustrated embodiment is shown as a channel extending at least partially along a middle portion of the body 130. The channel 125 is defined between two ribs 124 (shown in FIG. 3) and includes a cylindrical section 128 into which a portion of a broom handle can be retained, for example, the broom handle 305 shown in FIG. 10. The cylindrical section 128 further includes locking nubs 123, also shown in FIG. 3, which interlock and engage the broom handle 305 to lock and retain the same engaged within the handle clip 125 to pair the dustpan 100 with the broom 300 when not in use. In the illustrated embodiment, the dustpan 100 is made from a elastically flexible plastic material and, optionally, the lip 105 is made from a soft, thermoplastic elastomer (TPE) material to provide improved compliance with a rough floor surface 145, which in turn provides a better seal between the lip 105 and the floor 145. In the illustrated embodiment, the handle 135 further includes an opening 122 formed in the floor pad 135, and a strengthening rib 121 extending within the channel 125 and forming one of the locking nubs 123.

Figure 3:
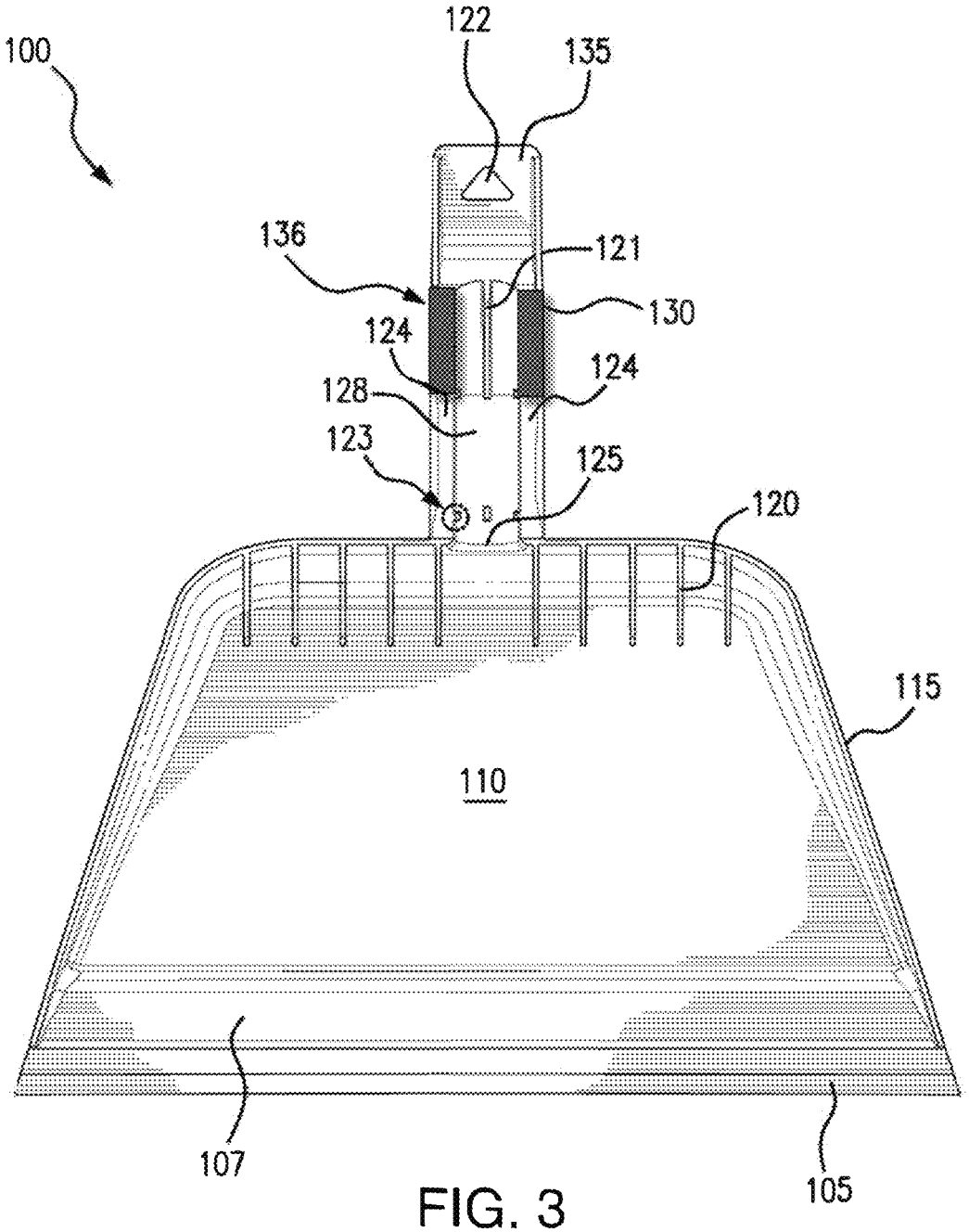
FIG. 3 is a top plan view of the step-on dustpan according to an embodiment of the disclosure.
Figure 4:
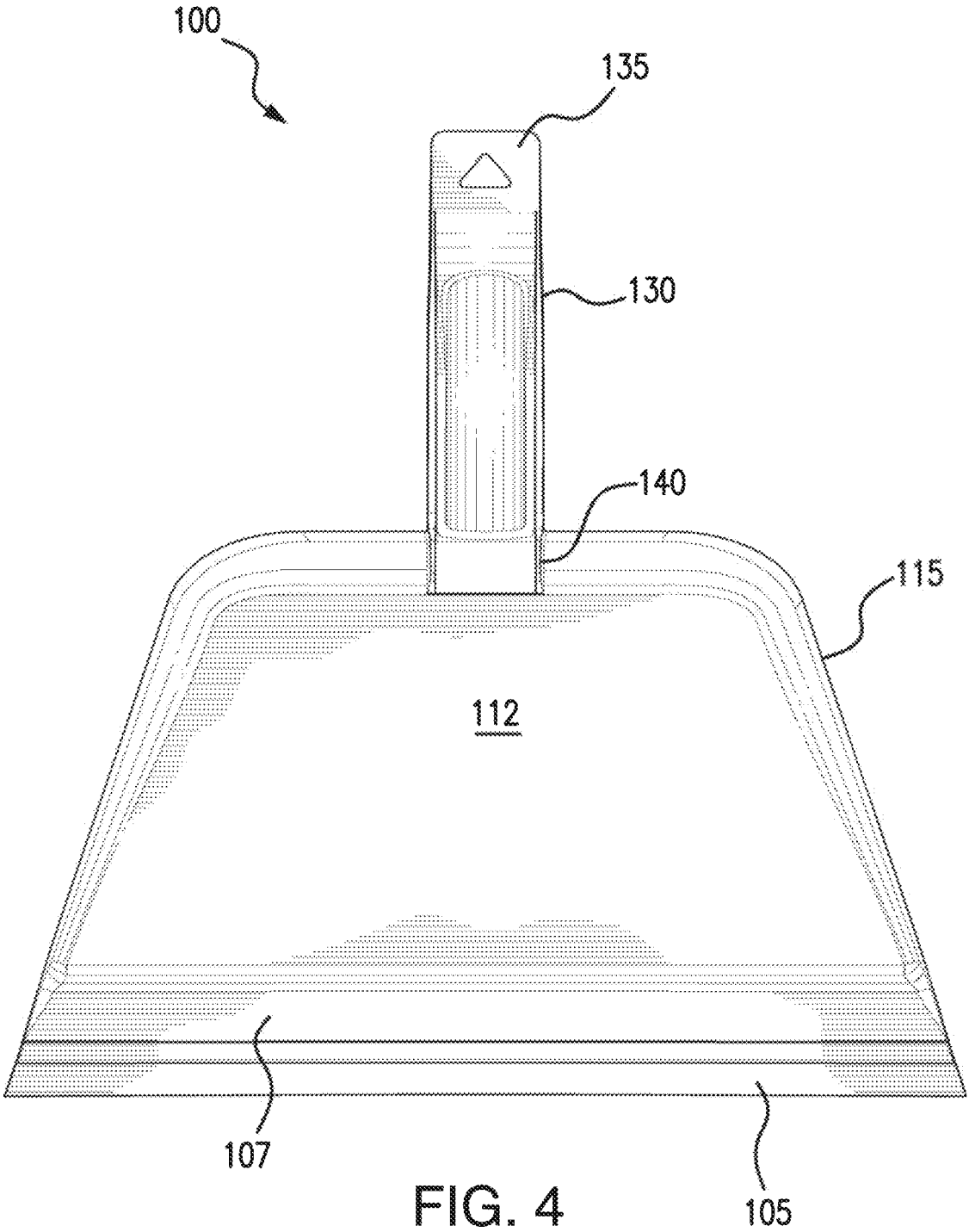
FIG. 4 is a bottom plan view of the step-on dustpan according to an embodiment of the disclosure.

Referring now to FIGS. 2, 3 and 4, various views of the dustpan 100 are shown including is a top and bottom plan view, respectively, of the step-on dustpan 100 according to an embodiment of the disclosure. In some embodiments, dustpan 100 comprises cleaning combs 120 disposed orthogonal to the pan entry lip portion 107 and lip 105, as shown. Also, dustpan 100 includes a pan bottom surface 112 disposed opposite pan surface 110 that faces the surface of floor 145, as shown in FIGS. 5 and 6.

Figure 5:
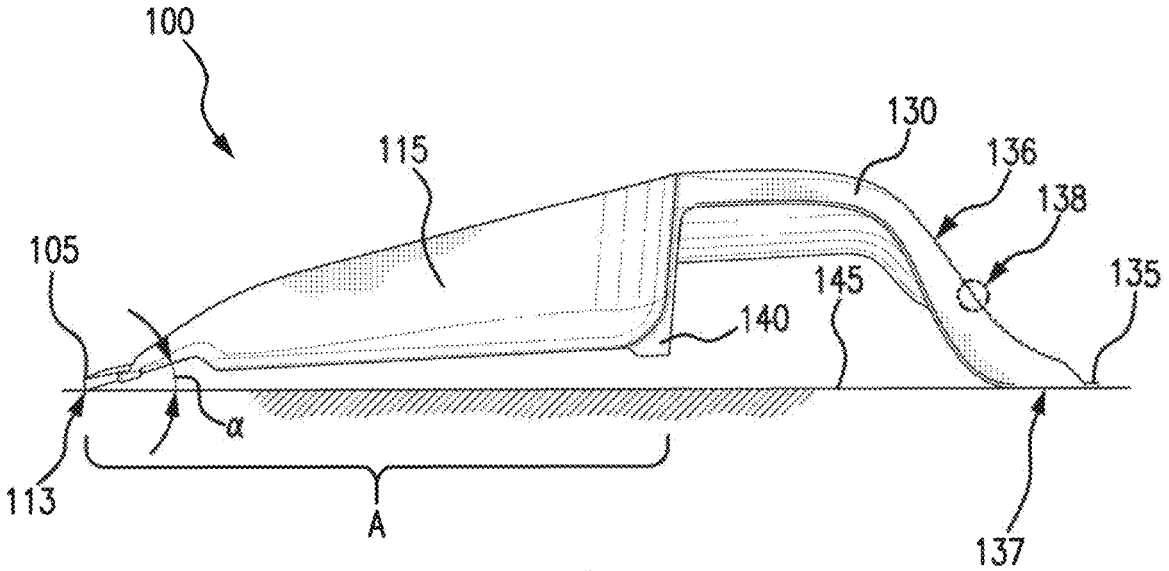
FIG. 5 is a side plan view of one side of the step-on dustpan according to an embodiment of the disclosure.

Referring now to FIGS. 5 and 6, there are side plan views of the step-on dustpan 100 according to an embodiment of the disclosure. In certain embodiments, dustpan 100 operates by a user engaging or stepping on step-on portion 135 after placing dustpan 100 upon floor 145 as shown. This step-on action causes lip 105 to engage floor 145 at the angle $\alpha$ to create a seal between lip 105 and floor 145 during a sweeping and collecting of debris by a user.

Figure 7:
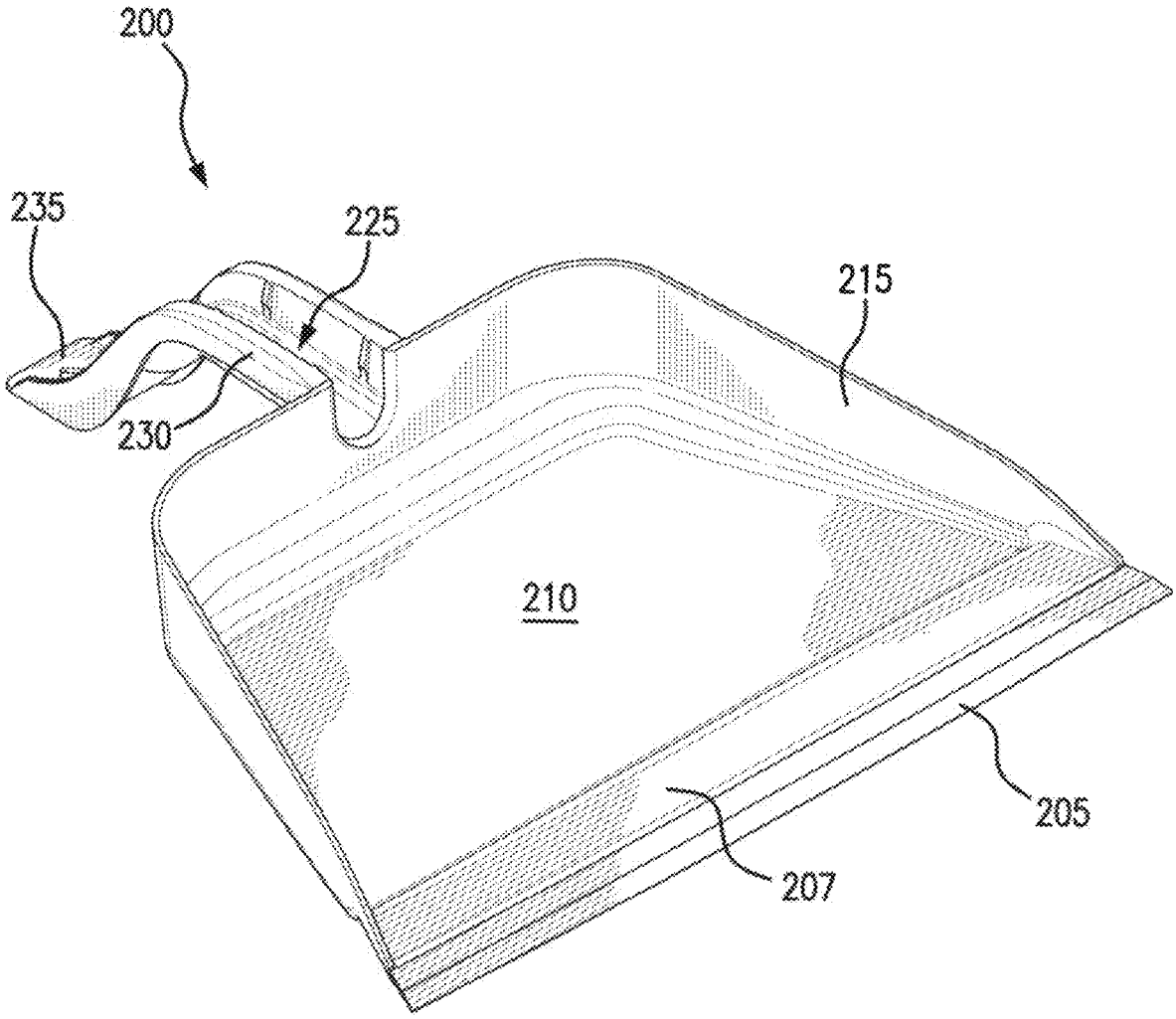
FIG. 7 is a front perspective view of a step-on dustpan according to another embodiment of the disclosure.
Figure 8:
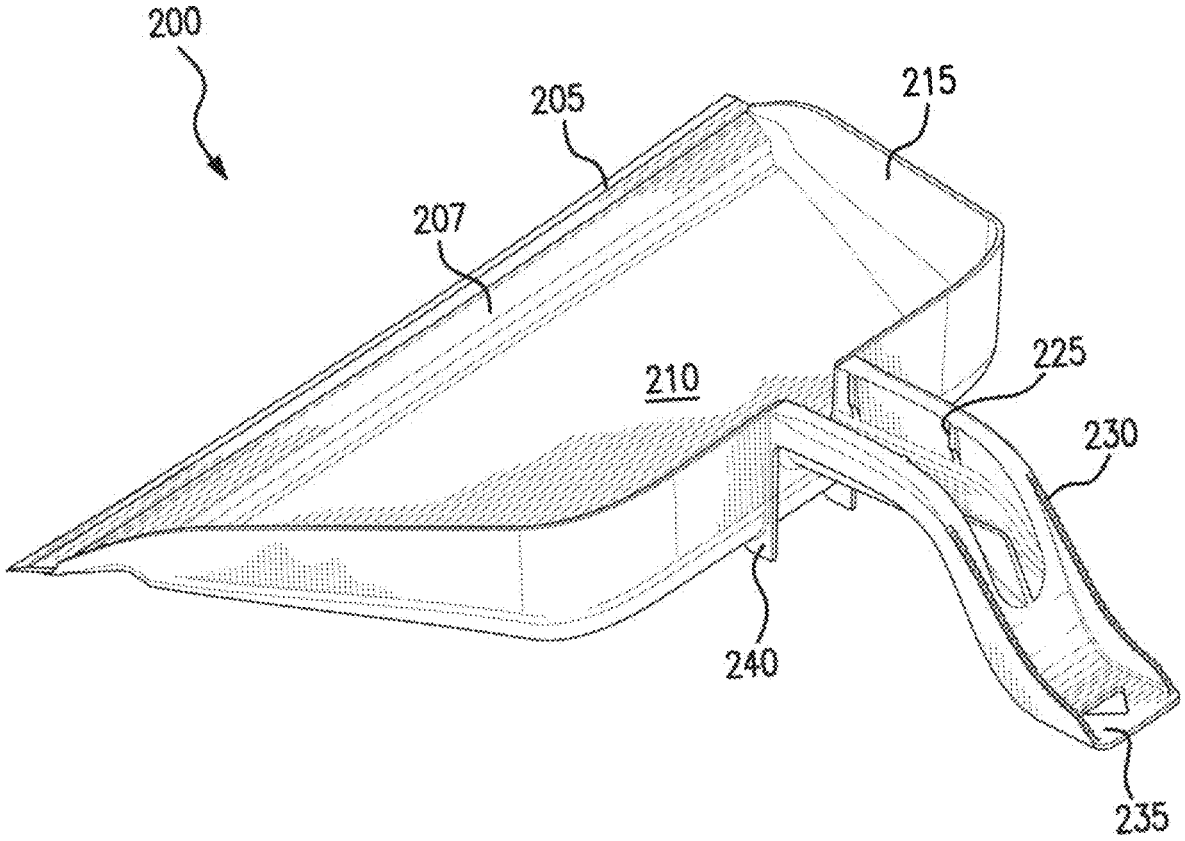
FIG. 8 is a rear perspective view of the step-on dustpan according to another embodiment of the disclosure.

Referring now to FIGS. 7 and 8, there are front and rear perspective views of an alternative embodiment of a dustpan 200 according to the disclosure. In some embodiments, dustpan 200 comprises a handle 235 configured to hold the dustpan 200 in place without the user having to bend or kneel to sweep debris into the pan surface 210 surrounded by side panels 215. In this embodiment, structures and features that are the same or similar to corresponding structures and features of the dustpan 100 described above are denoted by the same reference numerals as previously used for simplicity. In some embodiments, the action by a user of stepping on the handle step-on portion 235 of the dustpan 100 will deform the handle 230 to provide a biasing force that pushes a lip 205 (the leading edge of pan 210) against a floor 145 at an angle $\alpha$ to provide a better seal against dust or debris passing under the lip 205 rather than into the pan surface 210 when swept in past a pan entry lip portion 207. In certain embodiments, the angle $\alpha$ is between 20 to 30 degrees. In some embodiments, lip 205 is disposed within or integral to pan entry lip portion 207 where lip portion 207 is angled apart from pan surface 210.

Figure 9:
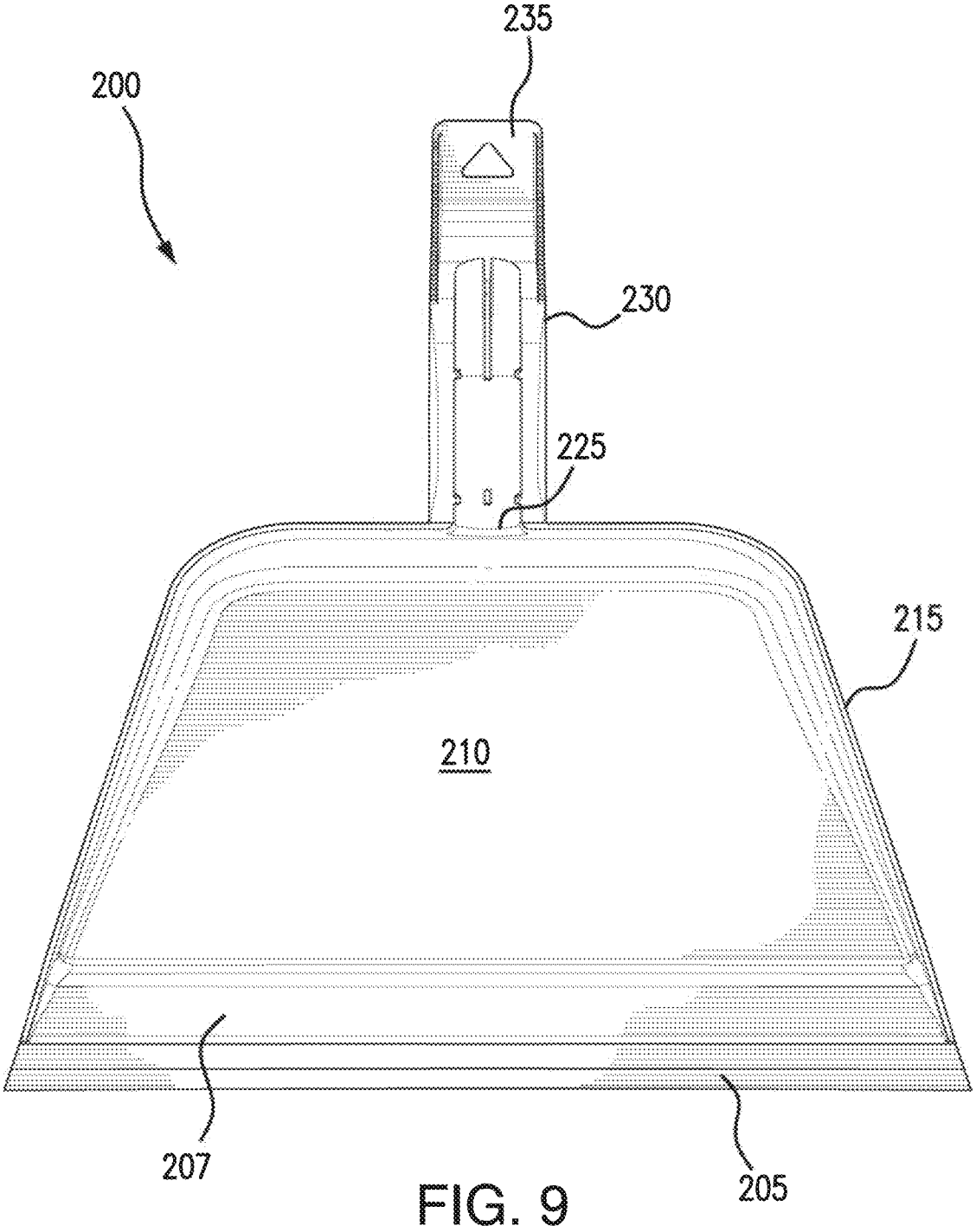
FIG. 9 is a top plan view of the step-on dustpan according to another embodiment of the disclosure.

Referring now to FIG. 9, there is a top plan view of the step-on dustpan 200 according to another embodiment of the disclosure. In some embodiments, the dustpan 200 includes a handle clip 225 for storage or attachment to a broom handle 305 and a Thermoplastic elastomers (TPE) lip 205 for sealed contact with the floor 145. In one aspect, the dustpan 200 is similar in function to the dustpan 100 but omits the comb 120.

Figure 10:
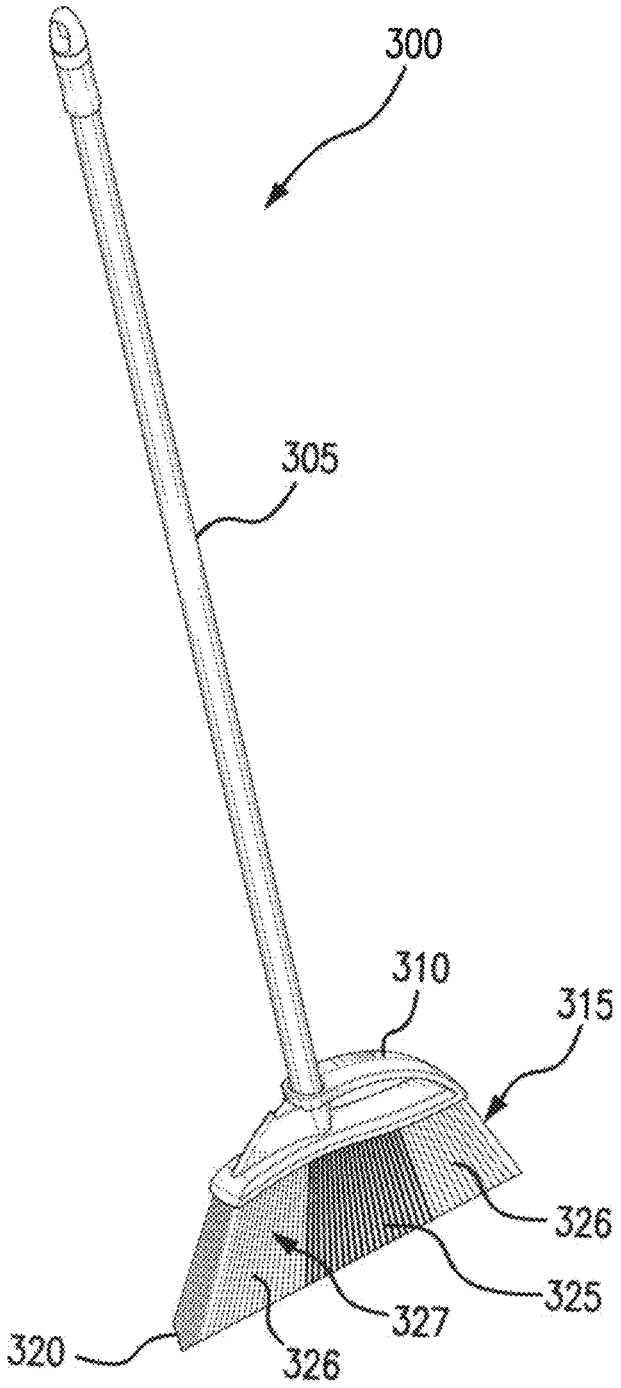
FIG. 10 is a perspective view of a beveled broom according to an embodiment of the disclosure.
Figure 11:
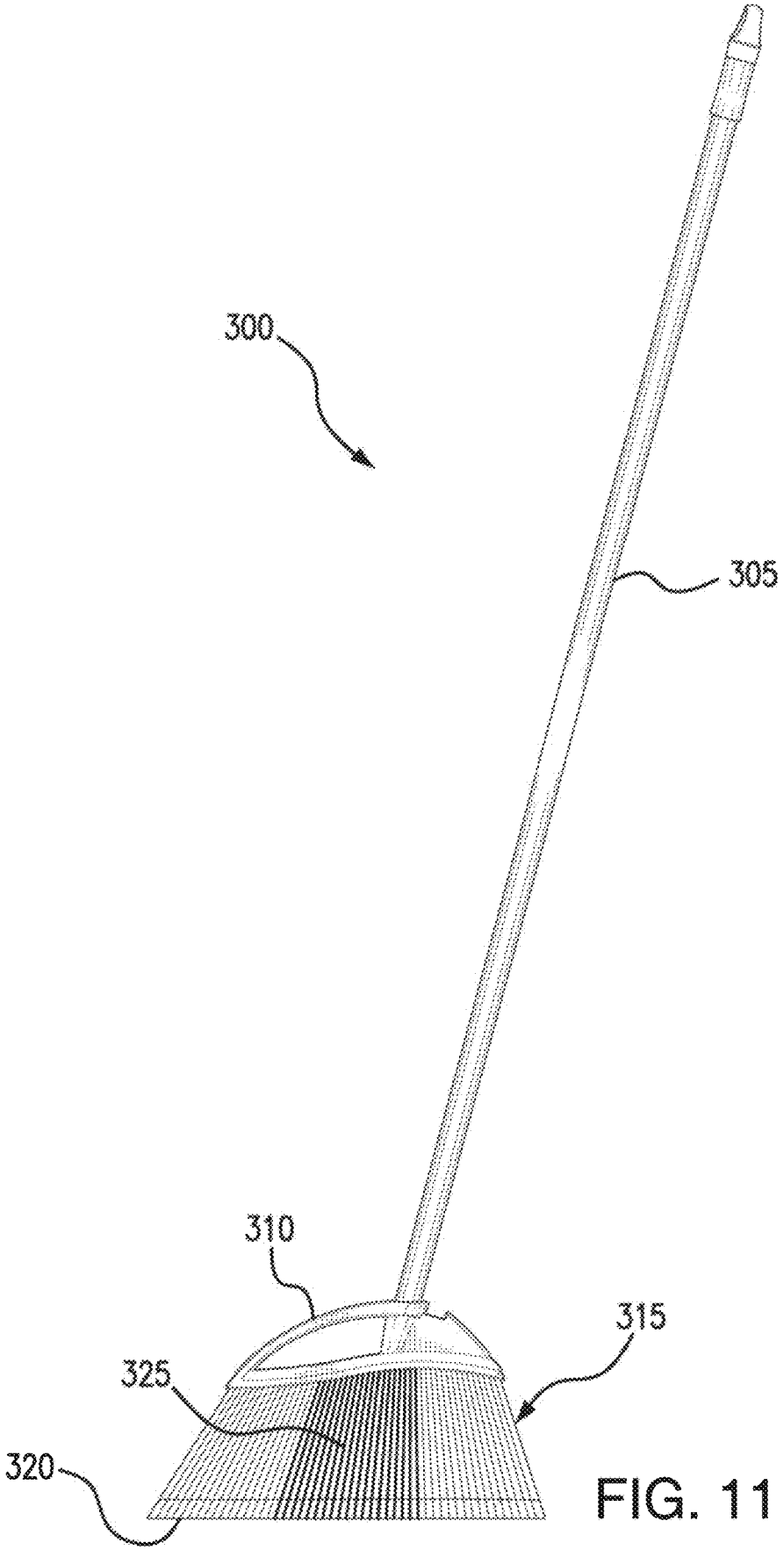
FIG. 11 is a side plan view of the beveled broom according to an embodiment of the disclosure.
Figure 16:
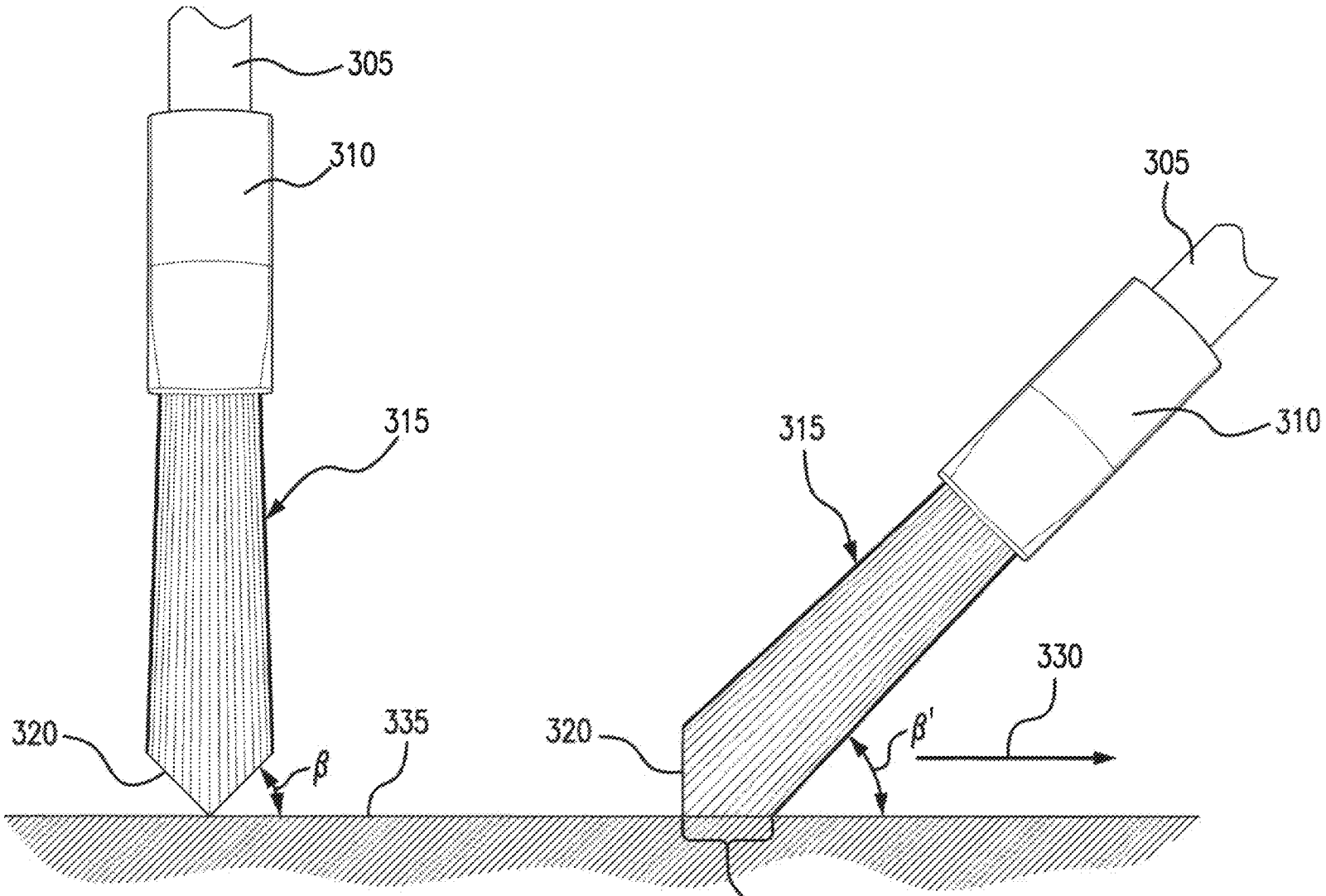
FIG. 16 is a compound side view of the beveled broom showing a sweep contact angle according to an embodiment of the disclosure.

Referring now to FIGS. 10 and 11, there are a perspective view and a side plan view of a beveled broom 300 according to an embodiment of the disclosure. In certain embodiments, the beveled broom 300 comprises a handle 305, a broom block 310 having a variety of bristles 315 disposed therein. In some embodiments, the bristles 315 are grouped in sections comprising different types of bristles. For example, a first section 325 is made from a first fiber at 0.75 mm diameter, and a second section 326 is made from a second fiber at 0.65 mm. As can be seen in FIG. 10, the first section 325 is disposed between two second seconds 326, for a total of three sections, each spanning about the same length along the broom block 310. The broom 300 further comprises a beveled or chamfered broom head 320 having angled trimming and flagging, $\beta$, on both sides. In certain embodiments, the broom head 320 provides increased floor contact as shown in FIG. 16 with flagged fiber versus conventional broom heads thereby collecting more debris while sweeping.

Figure 12:
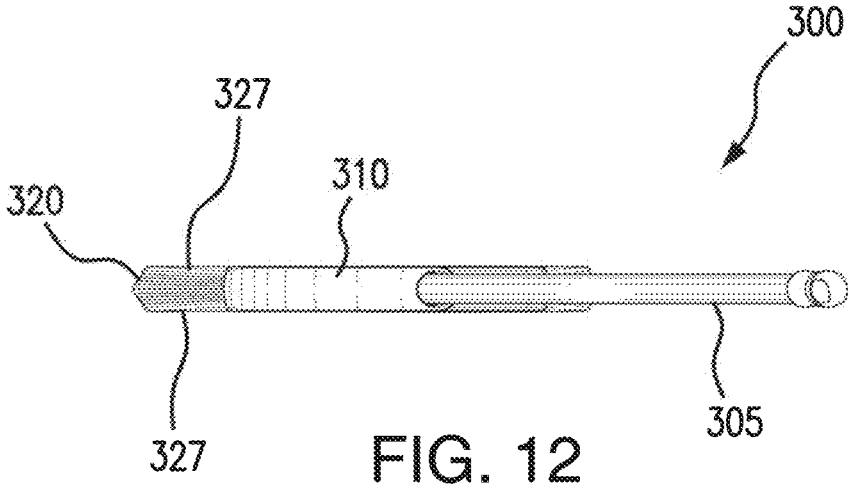
FIG. 12 is a top plan view of the beveled broom according to an embodiment of the disclosure.
Figure 13:
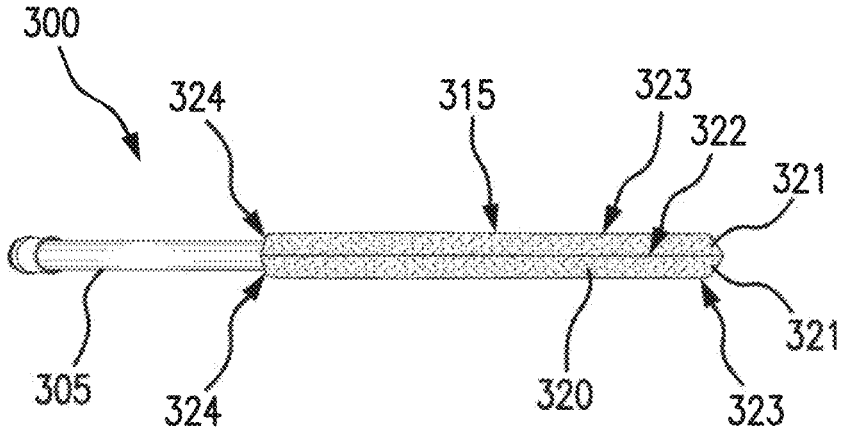
FIG. 13 is a bottom plan view of the beveled broom according to an embodiment of the disclosure.

Referring now to FIGS. 12 and 13, there is a top plan view and a bottom plan view of the beveled broom 300 according to an embodiment of the disclosure. In certain embodiments, the dual beveled or chamfered broom head 320 is configured to be at an angle of about 30 to 45 degrees for maximum surface contact area to the floor surface or ground 335 during use, as shown in FIG. 16. In certain embodiments, the broom 300 comprises a beveled broom head 320 including dual beveled or chamfered floor contact edges 340. As shown, also in FIG. 11, the chamfered broom head 320 defines two planar sections 321, each planar section defined by bristles that are cut such that their free ends all terminate at or about each planar section 321. Each of the planar sections 321 has an elongate shape that extends along the broom block 310 and is generally rectangular or trapezoidal defined between a bottom edge 322, along which the two planar sections 321 meet at the angle $\beta$, and two lateral edges 323, which coincide with the outer surface 327 defined by the bristles, as shown in FIG. 10. Side edges 324 are defined by the ends of the bristles at each end of the broom.

Referring now to FIG. 14, there is a perspective view of the step-on dustpan 100 and the beveled broom 300 according to an embodiment of the disclosure. In certain embodiments, the combination of the dustpan 100 and the broom 300 creates an advantage over conventional brooms and dustpans by the aspects discussed above with respect to more efficiently and effectively collecting debris in use. As can be seen here, the comb 120 passes through bristles to remove debris that may be longed or caught in the bristles. As the debris, which is generally denoted as 329, gets dislodged from the bristles, it falls within the receptacle 111.

Figure 15:
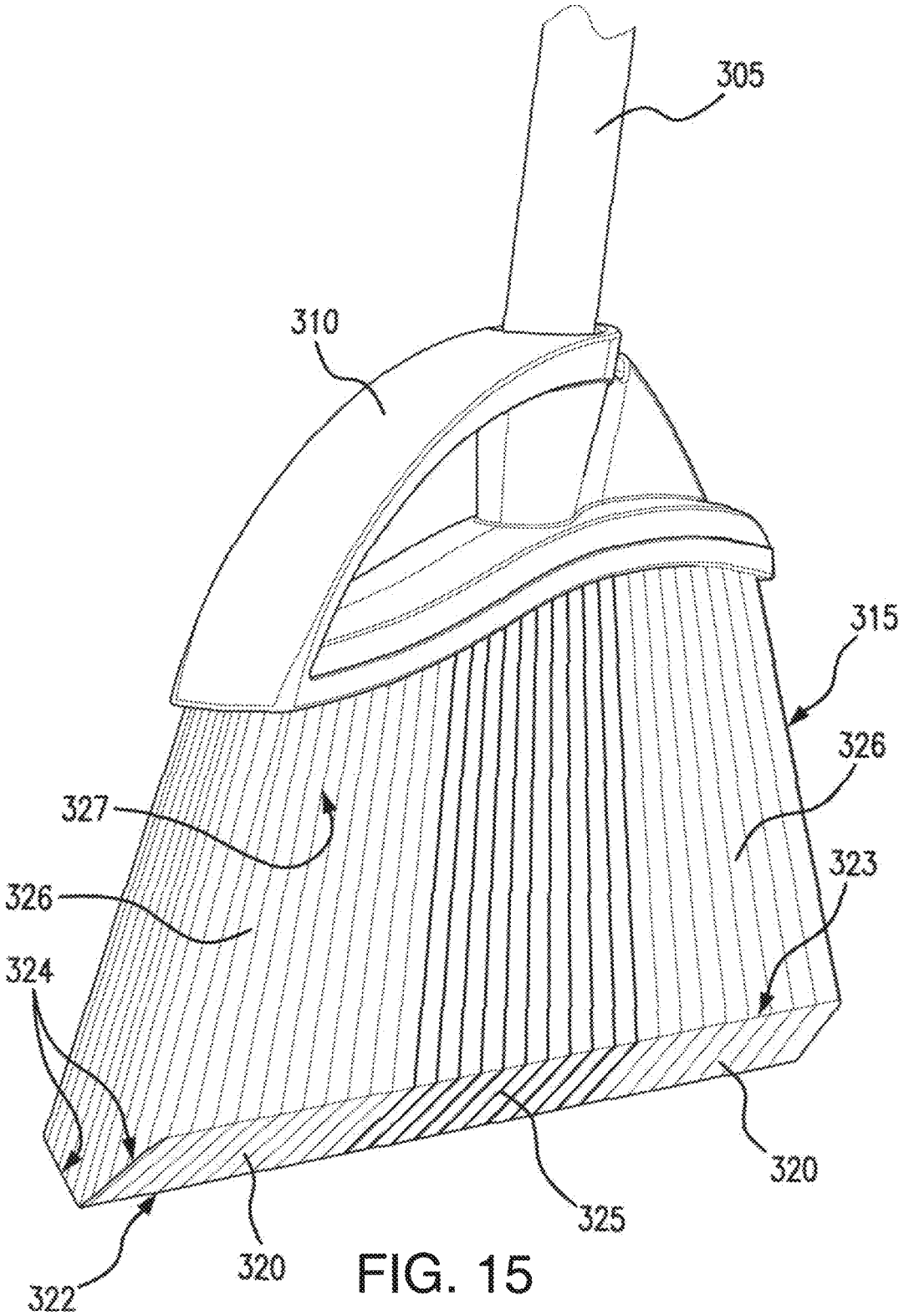
FIG. 15 is an enlarged perspective view of the beveled broom of FIG. 11 according to an embodiment of the disclosure.

Referring now to FIG. 15, there is an enlarged perspective view of the beveled broom 300 of FIG. 11 according to an embodiment of the disclosure. In some embodiments, broom 300 comprises dual bristles at 325 and at 320 to better capture and sweep debris of differing sizes which may pass through one set of bristles but get captured by the second set of bristles as discussed above.

Referring now to FIG. 16, there is a compound side view of the beveled broom 300 showing a sweep contact angle β according to an embodiment of the disclosure. In certain embodiments, broom 300 in use is configured to engage a floor surface 335 at an optimal angle, β', of about 30 to 45 degrees to effectively capture the maximum floor debris while sweeping in a direction 330 at a sweep contact surface 340 of bristles 315 of broom head 320 as shown. Advantageously, the beveled edge allows for use of the broom while sweeping in both forward and reverse directions (right and left in the orientation shown in FIG. 16).

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A dustpan, comprising:

a receptacle, the receptacle being enclosed on four sides by a bottom pan, two sidewalls and a back panel, the receptacle including a lip at a free end of the bottom pan opposite the back panel;

a handle connected to the back panel and extending opposite the receptacle, the handle having a curved shape that terminates at a floor pad, wherein the dustpan is configured to only contact a flat floor surface along the floor pad and the lip when in an at-rest position;

at least one foot disposed on an exterior surface of the receptacle and extending below the bottom pan;

a step-on portion defined on the handle, the step on portion configured to provide a surface for a user to apply a force;

wherein, when the force is applied to the step-on portion, the dust pan transitions from the at-rest position to an operating position in which the handle deforms to permit the at least one foot to further contact the flat floor surface and to decrease an angle between the lip and the flat floor surface.

2. The dustpan of claim 1, wherein the at least one foot and an exterior surface of the receptacle are suspended above the flat floor surface while the dustpan is in the at-rest position.

3. The dustpan of claim 2, wherein the exterior surface of the receptacle remains suspended above the flat floor surface when the at least one foot contacts the flat floor surface when the dustpan is in the operating position.

4. The dustpan of claim 1, wherein the handle comprises a cylindrical channel that is disposed between two ribs that extend along a longitudinal dimension of the handle.

5. The dustpan of claim 1, further comprising a comb connected to the back panel, the comb comprising fins that extend into the receptacle.

6. The dustpan of claim 1, wherein the handle and the receptacle are made from an elastically flexible plastic material, and wherein the lip is made from a soft, thermoplastic elastomer (TPE) material.

7. A cleaning system, comprising:

a broom having an elongate handle and a broom block connected at one end of the elongate handle;

a broom head comprising a first plurality of bristles connected to the broom block, the broom head having a sweeping end opposite the broom block, the sweeping end comprising two planar sections disposed at an angle relative to one another to define a bevel;

a dustpan having a receptacle connected to a handle, the receptacle having at least one foot disposed on an exterior surface thereof and extending below a bottom pan of the receptacle, the handle having a cylindrical channel with locking nubs that is releasable attachable to the elongate handle of the broom;

wherein the handle further includes a floor pad opposite its connection to the receptacle, and wherein the receptacle includes a lip disposed opposite its connection to the handle such that, when the dustpan is detached from the broom and sits on a flat floor surface in an at-rest position, the dustpan contacts the flat floor surface only along the floor pad and the lip, and remaining portions of the handle and the receptacle are suspended above the flat floor surface.

8. The cleaning system of claim 7, wherein the receptacle is enclosed on four sides by the bottom pan, two sidewalls and a back panel, and wherein the lip at a free end of the bottom pan opposite the back panel.

9. The cleaning system of claim 7, further comprising at least one foot disposed on the exterior surface of the receptacle.

10. The cleaning system of claim 9, further comprising a step-on portion defined on the handle, the step on portion configured to provide a pedal for a user to apply a force; wherein, when the force is applied to the pedal, the dust pan transitions form the at-rest position to an operating position in which the handle deforms to permit the at least one foot to further contact the flat floor surface and to decrease an angle between the lip and the flat floor surface.

11. The cleaning system of claim 7, wherein the first plurality of bristles is connected to a first section of the broom block, and wherein the broom block further comprises a second plurality of bristles connected to a second section of the broom block, wherein portions of the second section are disposed on either side of the first section along the broom block, and wherein the bevel is further defined by the second plurality of bristles.

12. The cleaning system of claim 7, wherein the two planar sections of the sweeping end are further defined between two lateral edges, which coincide with two corresponding outer surfaces of the broom head.

13. The cleaning system of claim 7, wherein the dustpan is configured such that, when a user applies a force on the step-on portion of the handle, the dustpan transitions from the at-rest position to an operating position in which the handle deforms to permit at least one foot connected to the receptacle and extending below a bottom surface of the receptacle to further contact the flat floor surface and to decrease an angle between the lip and the flat floor surface.

14. The cleaning system of claim 7, wherein the cylindrical channel is disposed between two ribs that extend along a longitudinal dimension of the handle.

15. The cleaning system of claim 7, further comprising a comb connected to a back panel of the receptacle, the comb comprising fins that extend into the receptacle.

16. The cleaning system of claim 7, wherein the handle and the receptacle are made from an elastically flexible plastic material, and wherein the lip is made from a soft, thermoplastic elastomer (TPE) material.

* * * * *